US005672028A

United States Patent [19]

Mehta

[11] Patent Number: 5,672,028

[45] Date of Patent: Sep. 30, 1997

[54] FLOOD CONTROL SYSTEM

[76] Inventor: Maheshkumar M. Mehta, P.O. Box 1472, Rockingham, N.C. 28379

[21] Appl. No.: 566,922

[22] Filed: Dec. 4, 1995

[51] Int. Cl.[6] ..... E02B 11/00

[52] U.S. Cl. ..... 405/36; 405/52; 405/87

[58] Field of Search ..... 405/36–48, 52, 405/15, 16; 404/2, 4; 210/170

[56] References Cited

U.S. PATENT DOCUMENTS

| | | | |
|---|---|---|---|
| 483,236 | 9/1892 | Nicholson et al. | 405/36 |
| 1,083,148 | 12/1913 | Sparks | 405/36 |
| 2,077,307 | 4/1937 | Bumpas et al. | 405/36 |
| 2,300,820 | 11/1942 | Vogel | 405/87 X |
| 4,307,975 | 12/1981 | Heitman | 405/36 |
| 4,557,646 | 12/1985 | Laesch | 405/36 X |
| 4,892,440 | 1/1990 | Regan | 405/52 X |
| 4,919,568 | 4/1990 | Hurley | 405/43 |
| 4,995,759 | 2/1991 | Plowman et al. | 405/45 X |
| 5,059,064 | 10/1991 | Justice | 405/43 X |
| 5,160,216 | 11/1992 | Takada et al. | 405/52 X |
| 5,228,802 | 7/1993 | Kuwabara et al. | 405/36 X |

FOREIGN PATENT DOCUMENTS

| | | | |
|---|---|---|---|
| 000245214 | 4/1987 | Germany | 405/36 |
| 1100372 | 6/1987 | U.S.S.R. | 405/36 |
| 001818409 | 5/1993 | U.S.S.R. | 405/36 |

*Primary Examiner*—Dennis L. Taylor
*Attorney, Agent, or Firm*—Charles Y. Lackey

[57] ABSTRACT

A flood water control system for reducing flooding formed in conjunction with multi-lane highways separated by medians wherein large holding basins are formed in the medians and flood water flowing into low land flows through directional ditches to the multi-lane highways and is thereafter transported through culverts to the holding basins. The culverts can be selectively opened and closed to control the collection of flood water in the holding basins.

6 Claims, 1 Drawing Sheet

FLOOD CONTROL SYSTEM

BACKGROUND OF THE INVENTION

1. Field of the Invention

This invention relates to a flood control system and more particularly to a flood control system in connection with multi-lane highways having medians wherein holding basins are formed to collect flood waters.

2. Description of the Prior Art

Increased urbanization of many parts of the country has caused significant increases in building and pavement coverage with a corresponding decrease in vegetation covered land needed to absorb rainfall. Villages have expanded to towns and towns have expanded to cities. A conventional means of moving water from buildings and pavement into free flowing streams consequently become inadequate to handle the volume of water that accumulates during heavy rainfall seasons. Moreover, a tendency to locate towns closer to large rivers and other bodies of water provides an additional risk during seasons of heavy rainfall.

Flood walls, jetties, berms and other means have been used to control flooding, however these have occasionally failed and a significant amount of damage occurs in any given failure.

OBJECTIVES OF THE INVENTION

It is therefore an objective of this invention to provide a flood water control system which prevents excessive discharge into local streams, and moves flood water from flood sensitive low lands to conveniently positioned holding basins formed in the median of multi-lane highways.

Another objective of the present invention is to provide a flood control system of the type described that is controllable to terminate flow when a holding basin has filled and redirect that flow to other unfilled basins.

SUMMARY OF THE INVENTION

The foregoing objects and others are achieved in accordance with this invention by a flood water control system for directing water flow from flood sensitive low lands for use with multi-lane highways separated by medians that utilizes a plurality of directional ditches extending from lowlands to multi-lane highways separated by medians in which large holding basins are formed. A plurality of culverts extend from the directional ditches near the highways to the holding basins and suitable means are provided to selectively open and close the culverts to initiate and terminate water flow into the holding basins.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting in any respect.

Those skilled in the art will appreciate that the concept upon which this disclosure is based may readily be utilized as the basis for designing other structures, methods and systems for carrying out the several purposes of this development.

It is important that the claims be regarded as including such equivalent methods and products resulting therefrom that do not depart from the spirit and scope of the present invention. The application is neither intended to define the invention of the application, which is measured by its claims, nor to limits its scope in any way.

Thus the objects of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

DETAILED DESCRIPTION OF THE PREFERRED EMBODIMENT

Figure 1:
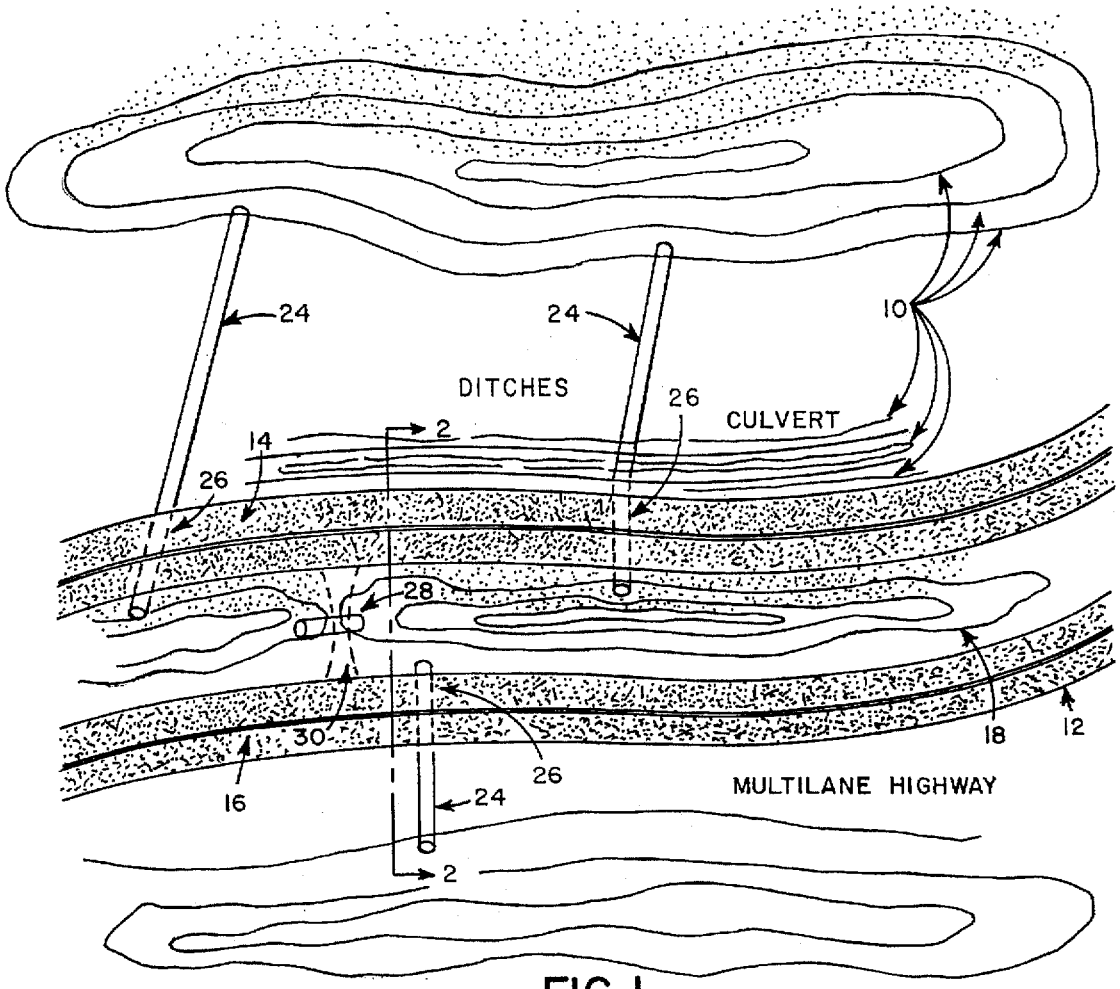
FIG. 1 is a plan view of a drainage system for a section of a multi-lane highway and its surrounding area formed in accordance with the present invention.
Figure 2:
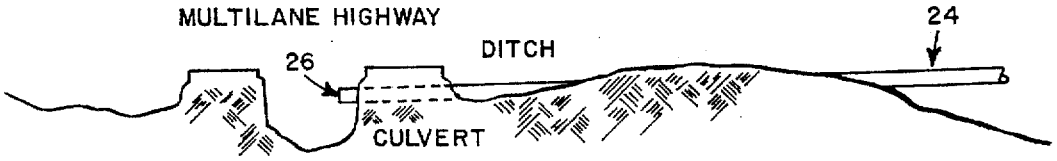
FIG. 2 is a sectional and end elevational view along line 2—2 of FIG. 1.
Figure 3:
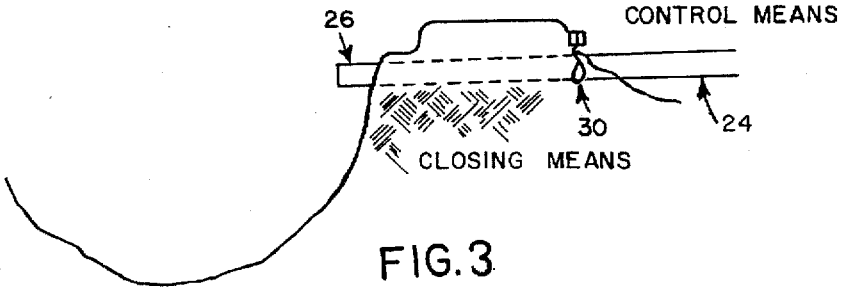
FIG. 3 is a sectional, end elevational, and enlarged view of a culvert like those utilized in the present invention having means for selectively opening and closing to initiate and terminate water flow into the holding basin.

Referring now to the drawings and particularly to FIG. 1, in which lines 10 represent contour lines or lines of constant elevational, the invention will be described with reference to a specific embodiment of a flood control system particularly adapted for use with a multi-lane divided highway. A divided highway shown generally as 12 includes first and second paved portions 14, 16 and requires a right of way or path substantially wider than the combined widths of the paved portions 14, 16. Parts of this path are used for grading and drainage on the outsides of the lanes and another portion 18 provides a median or dividing strip between lanes 14, 16.

The flood control system set forth herein is applicable to existing multi-lane highways with medians such as the interstate system and other primary dual lane roads with appropriate separation between each lane. Existing medians are usually flat, without structure and involve significant maintenance especially during the summer period when rainfall is heavy. Utilizing existing medians for the present invention means simply forming holding basins at those locations either in multiple form or in many cases substantially continuous holding basins extending for miles where the terrain is essentially flat.

Obviously, the system can readily be adapted to new dual lane highway construction and perhaps enhanced by having the multi-lanes separated to a greater extent to increase the size of the holding basins.

The system is formed by the provision of a plurality of directional ditches 24 extending from flood sensitive low lands where water immediately accumulates to selected areas adjacent the multi-lane highways near the basins. At the termination of ditches 24 near highway 12, a plurality of culverts 26 are installed from the ditch discharge area under the highway and into the holding basin so that flood water flows continuously from the flood low lands to the holding basins until a sufficient quantity has been collected and water flow is terminated. Such flow is controlled by appropriate means such as gate 30 to prevent basin overflow when a sufficient quantity of water has been accumulated. The water can be held for eventual evaporation or transported by other means such as culverts or pipelines to a remote nonflood sensitive location.

Median 18 is well suited for the establishment of holding basins. A series of abutments or small dams may be placed across the median at spaced points thereby sectionalizing or dividing it into a plurality of retention basins which store runoff from adjacent sections of land. Sectionalizing median 18 has the additional advantages of preventing the flow of runoff therealong for a substantial distance which tends to produce erosion. Water can be directed from one basin to another by providing additional culverts 28 or the like through the dams or abutments as indicated. Such culverts might be desirable where more runoff is expected to flow into one particular basin than into adjacent basins.

Because basins, directional ditches and culverts are advantageously formed in areas already disturbed by construction activity, there should be no significant incremental cost in forming these structures.

The foregoing discussion discloses and describes merely exemplary embodiments of the invention. One skilled in the art will readily recognize from such discussion and from the accompanying drawings and claims that various changes, modifications and variations can be made therein without departing from the spirit and scope of the invention as defined in the following claims.

What is claimed is:

1. A flood water control system for directing water flow from flood sensitive low land for use with multi-lane highways separated by medians comprising: a plurality of directional ditches extending from low land to multi-lane highways, a plurality of holding basins positioned in the median of the multi-lane highways; a plurality of culverts extending from the directional ditches under the highways to the holding section; and means to selectively open and close the culverts to initiate and terminate water flow into the holding basins.

2. The system as claimed in claim 1 further comprising a plurality of culverts connecting a plurality of holding basins with each other.

3. The system as claimed in claim 2 wherein the culvert opening and closing means further includes means to initiate and terminate water flow from basins to basins.

4. The system as claimed in claim 1 wherein the culvert opening and closing means are culvert gates.

5. The system as claimed in claim 2 wherein the culvert opening and closing means are culvert gates.

6. The system as claimed in claim 3 wherein the culvert opening and closing means are culvert gates.

* * * * *